US005165687A

United States Patent [19]

Soong

[11] Patent Number: 5,165,687

[45] Date of Patent: Nov. 24, 1992

[54] DAMPING LAYER ASSEMBLY WITH CONSTRAINING PLATE LAYER FOR SPORTS RACKET

[76] Inventor: Tsai C. Soong, 1839 Jackson Rd., Penfield, N.Y. 14526

[21] Appl. No.: 375,933

[22] Filed: Jul. 6, 1989

[51] Int. Cl.[5] ..... A63B 49/14

[52] U.S. Cl. ..... 273/73 C

[58] Field of Search ..... 273/73 R, 73 C, 73 D, 273/73 E, 735

[56] References Cited

U.S. PATENT DOCUMENTS

| | | | |
|---|---|---|---|
| 1,937,787 | 12/1933 | Robinson | 273/73 D |
| 4,044,625 | 8/1977 | D'Haem et al. | 273/73 J X |
| 4,181,301 | 1/1980 | Cholst-Serpoud | 273/73 C |
| 4,204,681 | 5/1980 | Hall | 273/73 C |
| 4,496,152 | 1/1985 | Mott | 273/73 C |
| 4,627,635 | 12/1986 | Koleda | 273/73 J X |
| 4,732,383 | 3/1988 | Ferrari et al. | 273/73 D |
| 4,776,592 | 11/1988 | Umlauft et al. | 273/73 C X |
| 4,811,947 | 3/1989 | Takatsuka et al. | 273/73 J |
| 4,828,259 | 5/1989 | Davis | 273/73 C |
| 4,875,679 | 10/1989 | Movilliat et al. | 273/73 C X |

FOREIGN PATENT DOCUMENTS

| | | | |
|---|---|---|---|
| 526615 | 9/1940 | United Kingdom | 273/73 C |

*Primary Examiner*—Edward M. Coven
*Assistant Examiner*—B. Stoll
*Attorney, Agent, or Firm*—Bernard A. Chiama

[57] ABSTRACT

A damping assembly for a sports racket is disclosed as being applied between a grommet or grommet strip associated with the racket and the racket frame to which the grommet or grommet strip is attached. The damping assembly includes a layer surrounding the outer surface of the frame preferably to at least 25% of the circumference. The layer is applied to the frame by adhesive material which allows the damping material to restrict frame vibration by shear-damping which resists shear deformation across the thickness and not along the length. The damping layer may be formed from a composite plate consisting of a number of plies of different grain orientation to optimize the shear-damping characteristics.

3 Claims, 3 Drawing Sheets

DAMPING LAYER ASSEMBLY WITH CONSTRAINING PLATE LAYER FOR SPORTS RACKET

BACKGROUND OF THE INVENTION

In a sports racket which uses strings such as tennis, squash etc. plastic grommet is used to guide a string through the interior of the frame through a string hole and exitting to the string network, so as to prevent the string from cutting into the stringframe contact surface which occurs when the frame is made of softer material such as graphite or composites, or to prevent the sharp edge of the hole to cut the string when the frame is made of metal. For high quality rackets, the grommets are molded in the form of a long band called in the trade as a grommet strip. The grommet strip at the head of the frame is occasionally designed to spread out along its width to cover the side of the frame, called wings, at the head portion so as to protect the surface of the frame head when the racket accidently hits the ground during play. There usually is a recess made in the frame of the head portion of the racket to receive the central part of the grommet strip to make the string less exposed so that the string will not be damaged when the head frame hits the ground accidently during play. Such grommet strip at the head of the frame of a racket is often called bumper guard which combines the function to guard the string as well as the grommet strip. In the specification here, bumper guard is the grommet strip used at the head portion which has wings spreading laterally to guard the frame; whereas a grommet strip is a narrow strip which has multiple grommets but does not protect the frame's surface.

When the frame vibrates at high frequency upon the impact of a ball which lasts only for a few thousandth of a second, the impact sets the network and the frame in motion with a sudden acceleration of which the attenuation of amplitude is slow because the hysteresis loss due to the internal macroscopic movement of the material under stress is small. Among the vibrating parts of the frame, vibration in the head portion of the frame is more severe and attenuation is slow because the head mass, incluiding the nearby strings and bumper guard, behaves as an unsupported overhanging cantilever, far way from the center of the racket and the handle. Prior art has seen a variety of plane forms of frame head design for the purpose of creating different bending rigidity and different vibration mode shapes to reduce vibration, but mostly they are not effective, in spite of racket manufacturers' claims to the contrary.

The invention recognizes an essential fact that for effective vibration design the deformation of the head frame caused by the vibration has to be constrained structurally and the vibratory energy is to be consumed more effectively than hitherto demonstrated in prior art, since the space available and weight consideration in the head frame impose a severely constrained design environment. By fitting a thin piece of rubber sheet under the bumper guard, between the bumper guard and the frame, not fastened with either surface, as was being done occastionally in prior art, is almost worthless to supress vibration at the head. It is because rubber is a poor damping material, it consumes no energy when sandwiched between the bumper guard and the frame.

The invention suggests that the damping layer used in the head frame has to be very efficient in damping. For example, in the case of a tennis racket, a designer can only afford to add at most 10 gm. in extra weight for damping purpose, for a 40 cm head frame length corresponding to the length of a bumper guard. Assuming a frame width of about 20 mm, and a material density of about 1.3, the thickness of the damping layer sandwiched in between the bumper guard and the frame can not be thicker than 1.0 mm. If width is reduced to 18 mm and weight allowance is increased to 15 gm, the thickness of the extra damping layer may be increased to 1.6 mm. This may be the upper limit to add a damping layer beneath the bumper guard in the head frame. With that little thickness to work on, the layer has to be very efficient in damping and ordinary elastomers or similar materials just wont't do.

Furthermore, how the vibration is to be damped, by shear or by extensional deformation is also important for this type of application. The damping layer should be tightly attached to the moving surface of the vibrating frame. Since the available thickness is so small, less than 1.5 mm thick, we should choose a damping material which restricts vibration principally by shear-damping which resists shear deformation across the thickness, not along the length. That is, the material resists shear movement much more effectively than it resists stretching. A characteristic of such material is that is difficult to be cut by a knife or by a pair of scissors. Such instruments cut a sheet by forcing an abrupt discontinuity in shear deformation. For scissors, it forces one edge up and the same edge down to achieve a breakage. So, for such material, a small amplitude movement in the direction of the vibrating surface of the frame will be picked up and resisted by the damping layer. Such shear resistance will be greatly enhanced if the other surface of the damping layer is not a free surface. That is, if it is fastened, such as by glue, to a thin plate, this will not allow the interface to move freely along the shear direction. This plate may be called constraining plate and does not have to be thick. It may be a thin aluminum sheet, or even a Nylon sheet, of a fraction of the thickness of the damping layer. If the damping layer is 1.5 mm, the constraining plate layer may be 0.5 mm. Or, if a constraining plate layer is not available, a thick damping layer, say 3 mm, may be a substitute. The additional mass above 1.5 mm may be taken as the constraining plate layer. At the head frame, the bumper guard can serve the purpose of a constraining plate layer very well.

The damping layer, in the present application, may even be formed from a composite plate consisting of a number of plies of different grain orientation to optimize the shear-damping characteristics even further. Therefore, in general, we shall name the damping device as a damping layer assembly consisting of the damping layer which may have multiple plies plus the constraining plate layer at the top. The said plies may be assembled ply by ply, one upon another, to become an integrated composite layer and applied to the frame by glue or other means. Or, the plies may be sprayed on under rigid control for material and thickness options to the surface of the frame of the racket at specific locations of the frame, with the constraining plate layer added at the end, if it is added al all.

DESCRIPTION OF A PREFERRED EMBODIMENT

Figure 1A:
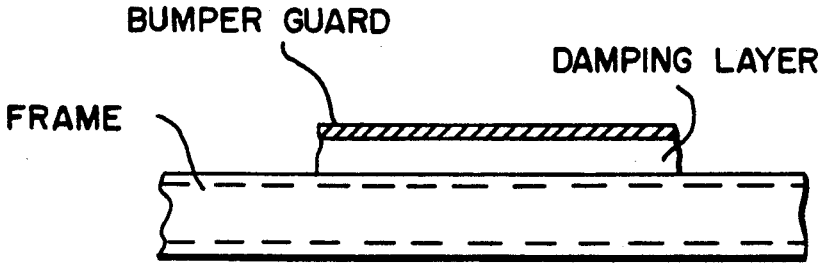
FIGS. 1*a* and 1*b* show how the damping layer resists the vibration of the frame with the aid of the constraining plate layer at its top.
Figure 1B:
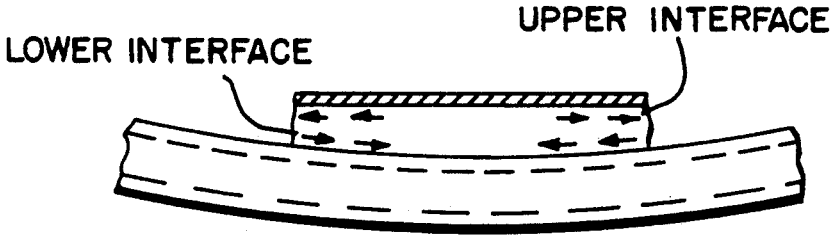

FIG. 1 illustrates how the damping layer assembly provides damping. In the upper figure the bumper guard (the constraining plate layer here) is glued, or by other means, to the damping layer, and the latter is glued to the surface of the frame. The lower figure shows the frame is having a bending vibration which is forcing the lower surface of the damping layer to contract due to the increased curvature of the interface as shown. The contraction is being transmitted to the upper surface through the thickness due to bending. But the bumper guard is stiff and will resist contraction from below. Therefore, the upper interface is showing an outward shear force acting on the upper surface of damping layer to resist the inward shear force on the damping layer from the bending frame below. Due to the strong shear damping property of the damping layer, the vibrating frame should feel a strong resistance from the damping layer, and its bending movement will be severely "damped" by this arrangement. This assembly works quite efficiently in spite of the small thickness of the damping layer used in this application. Even though a constraining plate layer enhances greatly the damping, the idea works even without the upper plate. In such case, the damping layer has to be much thicker, so that the upper portion of the layer may be taken as a constraining plate layer. In such application, the wings of a bumper guard may be removed and a narrow grommet strip is used in the head, and the protection of the head frame is provided by the "high-rise" thick damping layer on both sides of the grommet strip. There are two advantages of such device. One is that the thick damping layer absorbs ground impact shock better than a plastic bumper guard. The second is that a bumper guard is stiff and is difficult to be fitted onto the head frame. When the wings of a bumper guard is eliminated, the remaining grommet strip is narrow, more stretchable, and its grommet tubes can be much more easily fitted into the holes in the head frame. Racket stringers universally hate to install new bumper guard because of the difficulty. The present device would be a welcome relief to the trade in that respect.

Recent available new damping materials which can be used here, including some thermoplastics, for example, ISODAMP C-1000 series from Cabot Corp and DYAD from SOUNDCOAT Corp. Such semi-closed-cell thermoplastic alloy foams work like a dashpot, which offers very stiff resistance in shear when forced to move very fast. It can not be hurried beyond its natural pace, so to speak. A high frequency input to a dashpot will quickly be turned out-of-phase, and energy is quickly consumed due to randem and chaotic small amplitude harmonics. Rubber or similar elastomers used in prior art is clearly not suitable.

Figure 2:
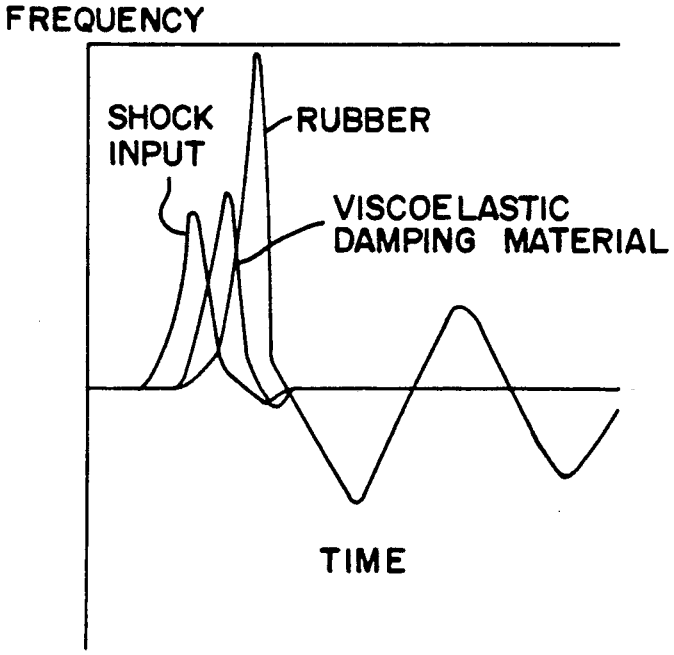
FIG. 2 shows damping by a rubber damper and by a viscoelastic damper.

FIG. 2 shows a rubber damper, which amplifies the impulse and continues with large amplitude vibration, whereas a viscoelastic damper diminishes the motion rapidly.

In addition, damping is enhanced when the contacting bodies have suitable normal pressure between them so that the sandwiched damping layer can pick up the surface movement of the exciting frame more promptly and resistance returned more quickly. In the present application, the string force is forcing down the cener part of the bumper guard (the grommet strip part) and is supplying pressure to the wings of the bumper guard to press the contacting damping layer down.

Figure 3:
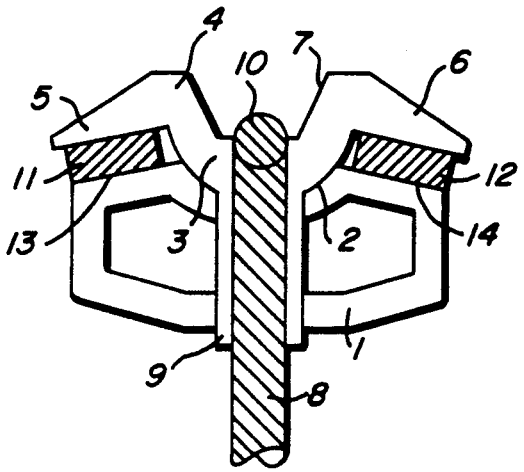
FIG. 3 shows a damping layer assembly consisting of bumper guard and damping layer, fastened to the surface of the head frame.

FIG. 3 shows the cross section of an inventive head frame assembly including the damping layer assembly. Frame 1 has a recess 2 to adapt to the grommet seat 3 of the grommet strip 4. Wing 5 and 6, together with grommet strip 4 constitute the bumper guard 7 used in the top head portion of the racket frame. String 8 extends to the string network through grommet tube 9. Note that due to the recess 2 and the height of wing 7, string 10 is not exposed and hence is protected. Note that even though the damping layer 11 and 12 as shown in the drawing is not extending into the recess 2 of the frame, but in all likelihood, they can extend into the recess and can even reach across the recess to join the other side of the layer, and form a continuously long single pad with multiple holes to accomodate the grommet tubes to get through. This freedom of design is understood to apply to all the figures shown, in the specification. Also, even though a recess is shown in FIG. 3, as well as in all figures, it is completely allowable in design to have less recess or even no recess, exposing the string to different degrees of exposure to impact. Also, interfaces 13 and 14 are glued or fastened by other permanent means at contact surfaces, or, when the material supplies very high friction and sliding is effectively prevented under normal pressure, the use of using permanent means of fastening each other at contact surface may be omitted. Such manufacturing options are always permitted without in any way weaking the new application as long as what makes the invention work and what distinguishes it from the prior art are clearly understood.

Figure 4:
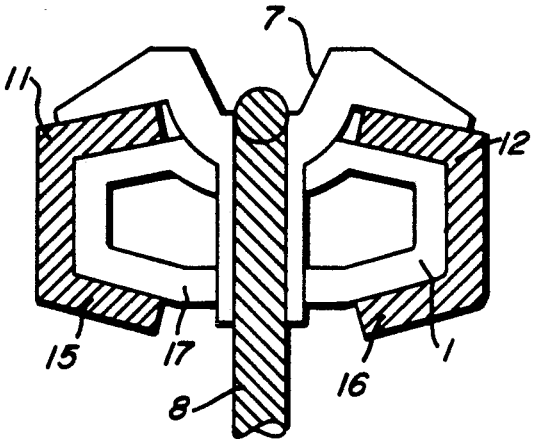
FIG. 4 shows the damping layer in FIG. 3 is covering both lateral sides and a part of the bottom of the frame.
Figure 5:
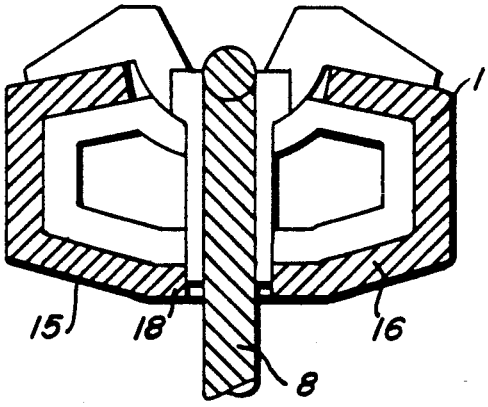
FIG. 5 shows the damper in FIG. 4 also covers the exitting holes of the grommets.
Figure 6:
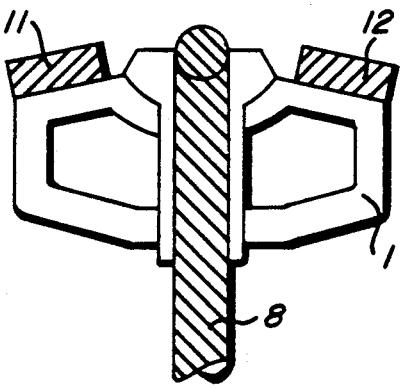
FIG. 6 shows the wings of the bumper guard in FIG. 3 eliminated, and the damping layer assembly is fastened on both sides of the grommet strip.
Figure 7:
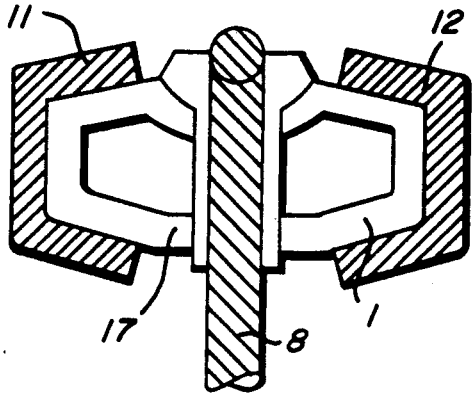
FIG. 7 shows the damping layer assembly FIG. 6 extending around the sides of the frame cross section.
Figure 8:
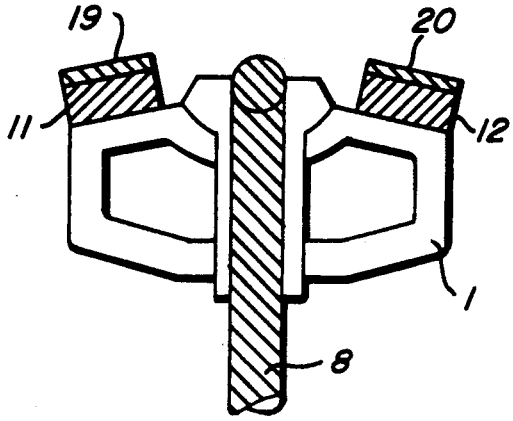
FIG. 8 shows the damping layer assembly in FIG. 6 having a distinct constraining plate layer.
Figure 9:
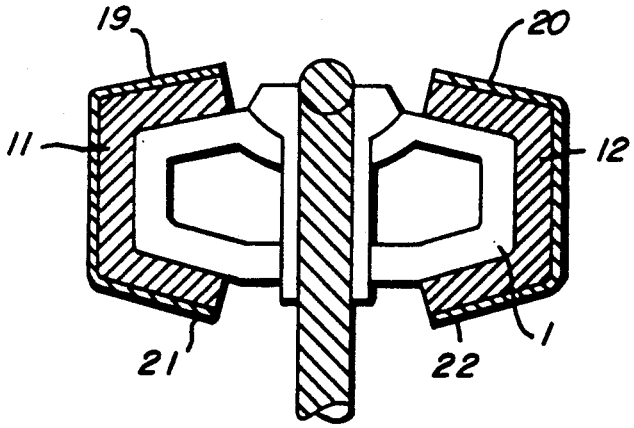
FIG. 9 shows the damping layer in FIG. 7 having a distinct constraining plate layer.

FIG. 4 shows the damping layer 11 and 12 of FIG. 3 extend downward to 15 and 16, covering the bottom 17 of the frame section 1. Such a longer wrapping around of the cross section of the frame is evidently better for damping. Even though according to the drawing, 15 and 16 stop at the lower sides of the frame, they may be terminated at the lateral side of the frame section, or at any point in the section circumference. FIG. 5 shows the lower damping layer 15 and 16 are connected at 18, becoming a single piece with multiple holes to accommodate the grommet tubings. FIG. 6 shows that wings 5 and 6 in FIG. 3 are removed, grommet strip remains, and only the damping layers 11 and 12 are used. These damping layers may extend to the lateral sides of the section and FIG. 7 shows they extend to the lower region 17 of the section. This design may be used in the head region where the string is recessed enough and may be protected by the damping strips alone without the need for wings 5 and 6. Or it may be used in the side regions of the frame of a racket where the frame will not contact the ground. FIG. 8 shows the constraining plate layer 19 and 20 are permanently attached to the damping layers 11 and 12. FIG. 9 shows the constraining plates are extended to cover the whole length of the damping layer to 21 and 22.

Prior art has rackets whose lateral side frames have additional small weights attached to it for increasing the twisting moment of inertia of the racket. For the present application, it is an ideal place to replace these small weights at the laterlal sides of the frame by a suitable length of the damping layer assembly. Then the additional weight not only serves the purpose of increasing the twisting moment of inertia of the racket, but also increasing the damping of the frame it covers. Since longitudinal vibration modes are important to racket vibration, means to damp the long lateral sides of the frame with no weight penelty is a valuable contribution of the present application.

Since the damping layer assembly reduces vibration of the frame by offereing resistance to its vibratory motion, the more length along the circumference of the cross section of the frame the damping layer assembly covers, the better would be the damping result. It implies then there is a minmum covering length along the circumference of a frame section, less than that the damping effect would be minimal and is not worthy even to try. That minimum length is about a quarter of the circumference. In the head frame region, if wings of the bumper guard is eliminated and the damping layer assembly is also to assume the protection of the string, the minimum length may be smaller than that.

In order to replace worn-out damping layer assembly of a sports racket, it may be made as spare parts, with means provided to be able to be put on a racket without having to take away existing grommet strips.

I claim:

1. In a sports racket having a frame defined by a head region, lateral side regions encompassing most of a string network, a throat region completing the lateral side regions, a shank region connecting the throat region to a handle, and a bumper guard secured to the outer surface of the head region where strings of the network pass through, the improvement including at least one damping strip arranged between the outer surface of the head region and the bumper guard, said damping strip being adhesively secured to the coacting surfaces of the head region and the bumper guard, and subjected to the pressure therebetween effected by the forces of the strings passing therethrough.

2. The sports racket as defined in claim 1 wherein said damping layer is positioned upon the outer surface of the head region whereby the strings passing therethrough are arranged approximately along the centerline of said damping layer.

3. The sports racket as defined in claim 1 wherein said damping layer is made of a single layer of viscoelastic material.

* * * * *